US005677596A

United States Patent [19]

Mueller et al.

[11] Patent Number: 5,677,596

[45] Date of Patent: Oct. 14, 1997

[54] PLUG WITH RADIATION SCREENING ELEMENT

[75] Inventors: Alexander Mueller, Reutlingen; Thomas Fabry, Neckartenzlingen; Peter Kusserow, Sonnenbuehl; Thomas Loeffler, Hechingen, all of Germany

[73] Assignee: Robert Bosch GmbH, Stuttgart, Germany

[21] Appl. No.: 593,789

[22] Filed: Jan. 30, 1996

[30] Foreign Application Priority Data

Feb. 22, 1995 [DE] Germany ..... 295 02 977.3

[51] Int. Cl.[6] ..... F21K 7/00; H01J 1/00

[52] U.S. Cl. ..... 315/58; 315/85; 362/265

[58] Field of Search ..... 439/242, 76.1, 439/226; 362/265, 226, 61; 315/58, 56, 338, 344, 267, 236, 85

[56] References Cited

U.S. PATENT DOCUMENTS 5,188,444 2/1993 Makita ..... 362/80

5,434,763 7/1995 Hege et al. ..... 362/265

FOREIGN PATENT DOCUMENTS 4310307 3/1993 Germany .

*Primary Examiner*—Robert Pascal
*Assistant Examiner*—David Vu
*Attorney, Agent, or Firm*—Michael J. Striker

[57] ABSTRACT

A plug has a two-part housing accommodating a printed board with an electrical screening element for preventing propagation of electrical disturbing radiation during the operation of a gas discharge lamp. A mass of a durable elastic material such as silicon is applied on a part of the periphery of at least one screening element between the screening element and the adjoining housing part. The inner space of the housing is filled with a casting mass of an electrically insulating material in which also an elastic mass is enclosed. The elastic mass uncouples the screening element from the housing and from the casting mass, so that a thermal expansion of the screening element is possible and also vibrations of the plug are not rigidly transmitted to the screening element.

8 Claims, 4 Drawing Sheets

PLUG WITH RADIATION SCREENING ELEMENT

BACKGROUND OF THE INVENTION

The present invention relates to a plug for contacting a gas discharge lamp.

Such a plug is disclosed for example in the German patent document DE 43 10 307 A1. The plug contains at least one electrical screening element which prevents propagation of the electromagnetic radiation from the gas discharge lamp during the operation along the connecting conductors connected with the plug. The plug has a housing composed of an electrically insulating material. The screening element is arranged in the housing, and the housing is filled with a casting mass of an electrically insulating material. The at least one screening element and the casting mass have different thermal expansion coefficients. The screening element and the casting mass are heated during the operation of the gas discharge lamp with a resulting volume expansion. When the casting mass completely fills the housing, this leads to the situation that the screening element is loaded with pressure which negatively affects its operation and service life. Moreover, the screening element is connected with the housing rigidly through the casting mass, so that the vibrations are directly transferred to the screening element, which also negatively affects the service life of the screening element.

SUMMARY OF THE INVENTION

Accordingly, it is an object of the present invention to provide a plug for contacting a gas discharge lamp, which avoids the disadvantages of the prior art.

In keeping with these objects and with others which will become apparent hereinafter, one feature of the present invention resides, briefly stated, in a plug for contacting a gas discharge lamp in which a mass of a durable elastic material is arranged between at least a part of a periphery of at least one screening element and an adjoining housing and/or an adjoining casting mass.

When the plug is designed in accordance with the present invention it has the advantage that the at least one screening element and the casting mass during heating can expand to the elastically deformable mass, and thereby the screening element is not loaded with pressure so extensively. Moreover, the at least one screening element is uncoupled by the elastically deformable mass from the housing and the casting mass, so that the vibrations of the plug are not directly transmitted to the screening element. As a whole, the at least one screening element of the inventive plug has an increased operational safety and a longer service life.

In accordance with another feature of the present invention, a plurality of screening elements can be arranged on a printed board and form together with it a pre-mounted structural unit insertable in the housing. The housing can hold at least one electrical contact for contacting the gas discharge lamp, and a contact element arranged on the printed board contacts with said first mentioned contact element during insertion of the printed board into the housing.

At least one further contact element can be arranged on the printed board and extend outwardly through an opening in the housing so as to directly contact the gas discharge lamp.

The housing can be formed as a two-part element so that, the printed can be insertable in a first housing part in which the contact element is held and on which the printed board is connected with its contact element, while the second housing part is connectable with the first housing part for covering the printed board, and also can have the opening for passage of the further contact element of the printed board.

When the plug is designed in accordance with these features, it is easy to assemble.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
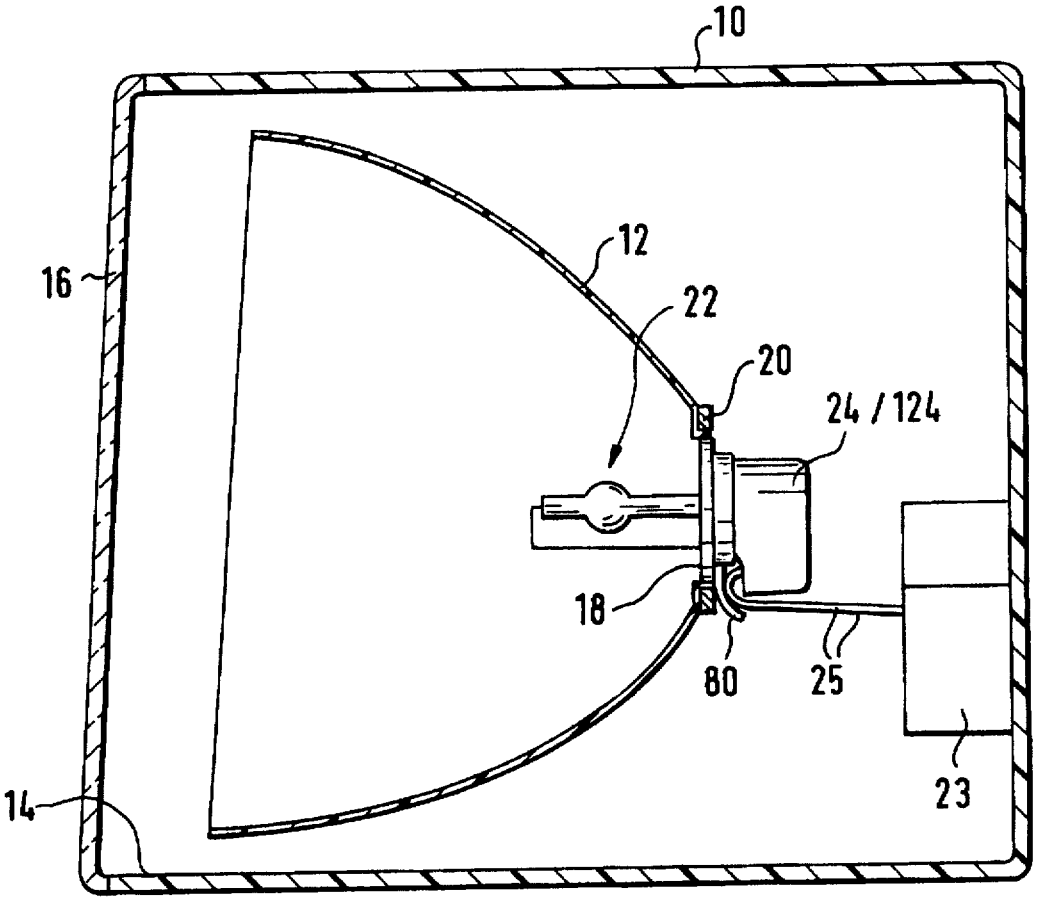
FIG. 1 is a view showing a headlight for a vehicle in vertical longitudinal cross-section, with a gas discharge lamp and a plug for contacting the gas discharge lamp.

A headlight for a vehicle, in particular a motor vehicle, shown in FIG. 1 has a housing 10 with a reflector 12 adjustably arranged in the housing. The housing 10 at its front end is provided with a light outlet opening 14 closed by a cover disc 16. A gas discharge lamp 22 is inserted in the reflector 12 in an opening 18 in its apex through a lamp carrier 20 and is held on the lamp carrier in a not shown manner. For contacting of the gas discharge lamp 22, a plug 24 is connected with the gas discharge lamp. The plug 24 is connected with an electrical pre-switching device 23 by two connecting conductors formed as cables 25, for operation of the gas discharge lamp 22. The pre-switching device 23 can be arranged inside the housing 10.

Figure 2:
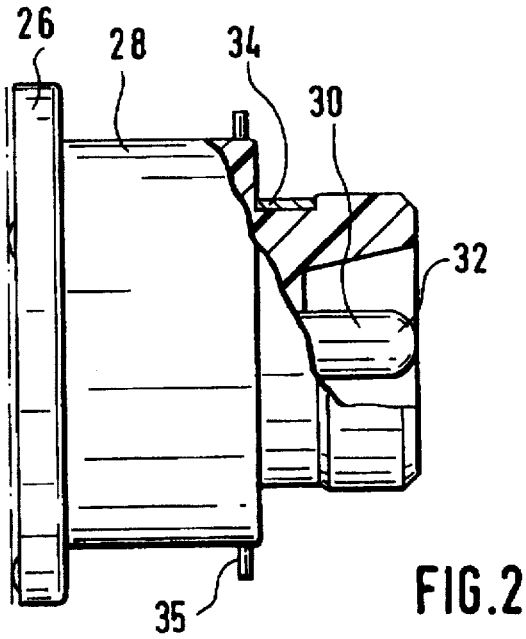
FIG. 2 is a view showing a socket of the gas discharge lamp in a partial longitudinal section on an enlarged scale.

As shown in FIG. 2, the gas discharge lamp 22 has a socket 26 composed of an electrically insulating material, such as ceramic or synthetic plastic. The socket 26 has a circular-cylindrical portion 26 facing away from the reflector 12. The portion 28 has a depression 30 which extends from its end side and conically narrows toward the reflector 12. A plug connection 32 extends substantially centrally in the depression 30 through the socket 26, for one of the electrodes of the gas discharge lamp 22. It is formed for example as a round plug pin. A closed metal conducting ring 34 is arranged on the outer periphery of the socket portion 28 and connected with the other electrode of the gas discharge lamp 22. Two diametrically opposite pins 35 extend radially from the surface of the portion 28 of the plug 26 of the gas discharge lamp 22.

Figure 3:
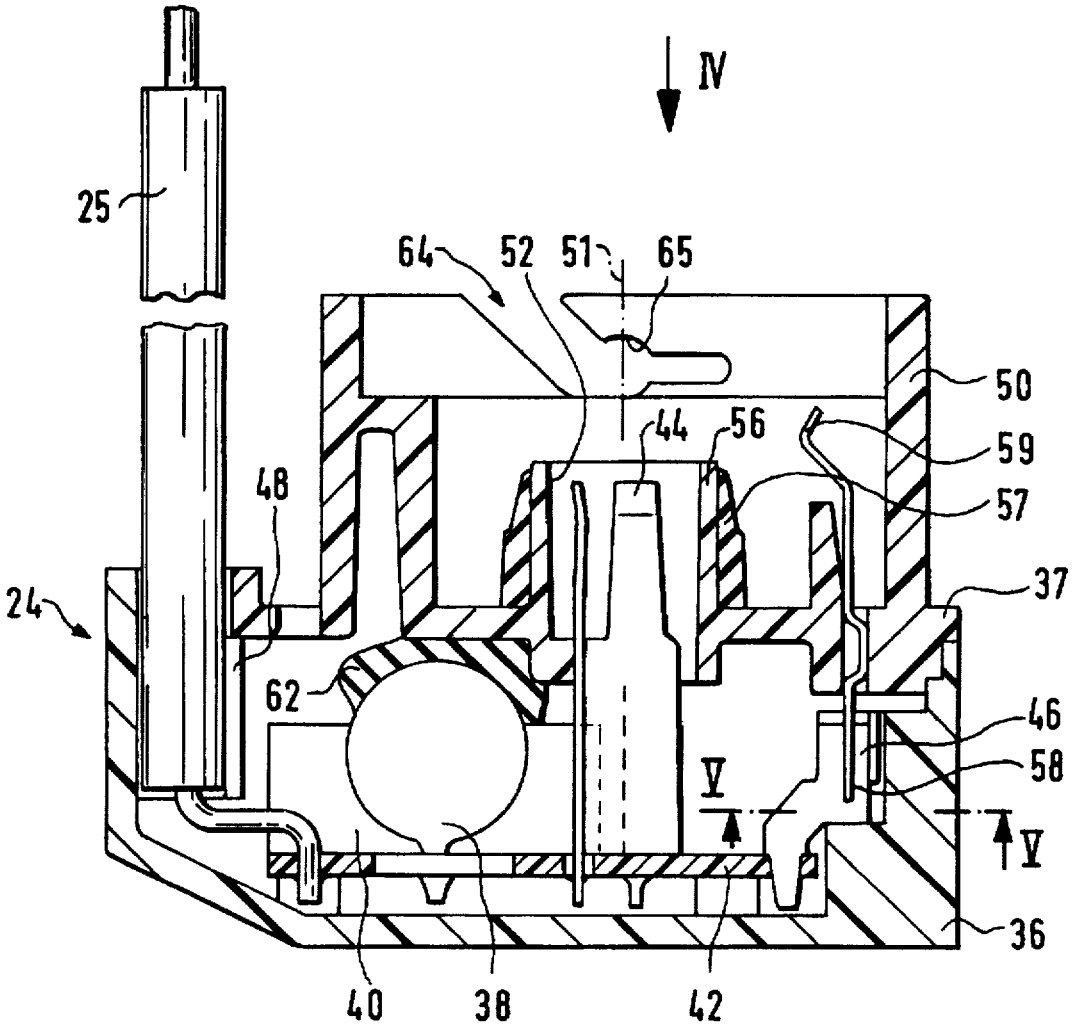
FIG. 3 is a view showing the plug in accordance with a first embodiment of the present invention on an enlarged scale in a longitudinal section taken along the line III—III in FIG. 4.
Figure 4:
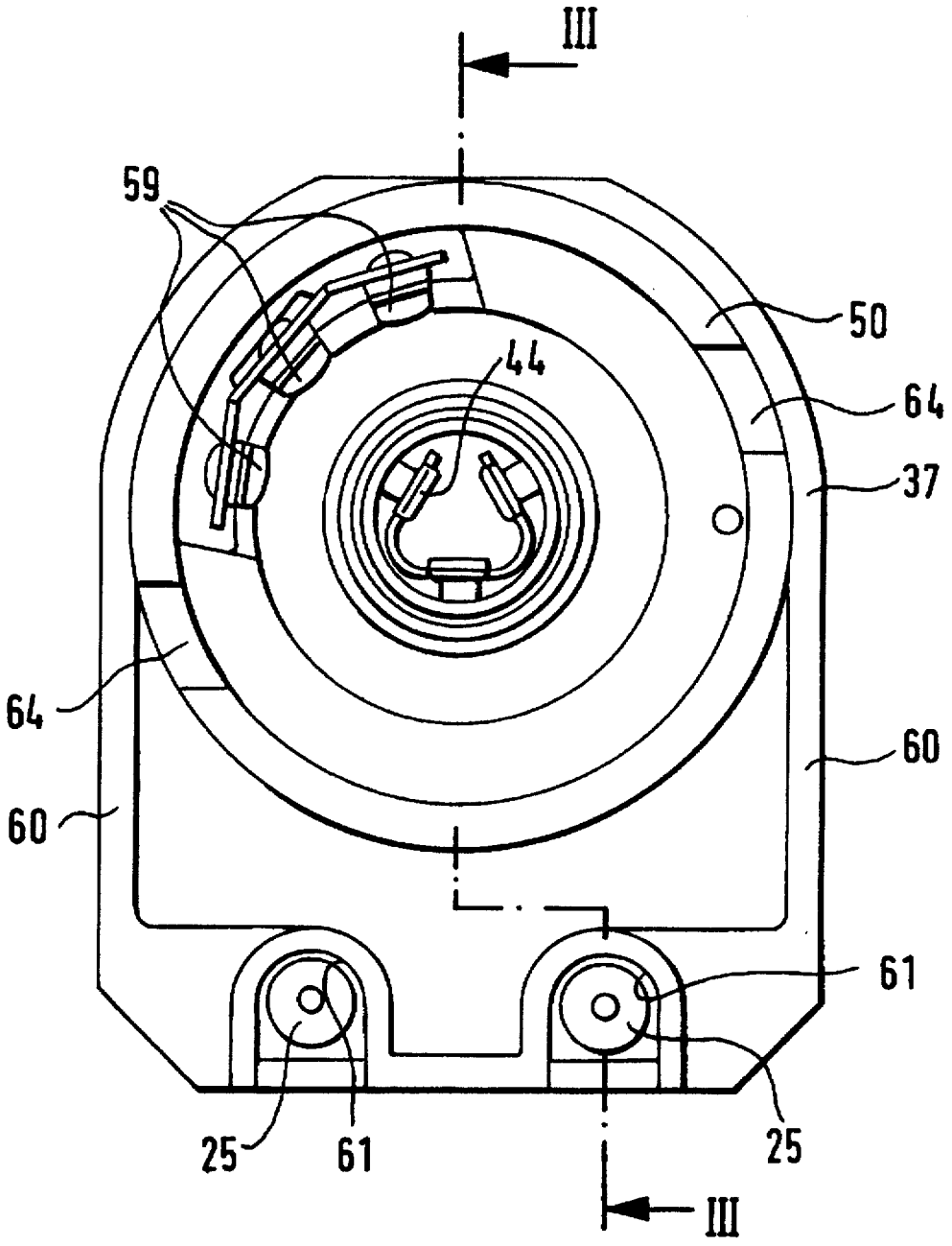
FIG. 4 is a view of the plug as seen in direction of the arrow IV in FIG. 3.
Figure 5:
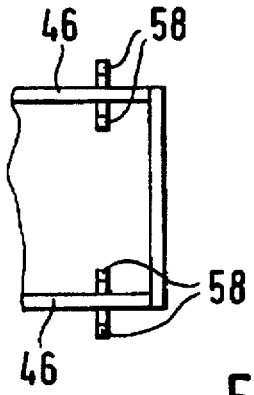
FIG. 5 is a view showing a plug in partial section taken along the line V—V in FIG. 3.

The plug 24 in accordance with a first embodiment is shown in FIGS. 3–5. It has a housing composed of two housing parts 36 and 37. The housing parts 36, 37 are composed of an electrically insulating material, for example plastic. As shown in FIG. 3, the first housing part 36 is cup-shaped and its opening closed by the second housing part 37. Therefore an inner chamber substantially limited by the housing parts 36 and 37 is formed. The housing part 37 has means for mounting the plug 24 on the socket 26 of the gas discharge lamp 22.

At least one electrical screening element formed as a capacitor 38 and/or coil 40 is arranged in the inner chamber of the plug 24 formed by the housing parts 36, 37. It prevents propagation of electromagnetic perturbing radiation produced during the operation of the gas discharge lamp 22, along the connecting conductors 28. Preferably, one coil 40 is connected in series with each of the two connecting conductors 25, and a capacitor 38 is arranged both before the both coils 40 as well as after the both coils 40 parallel to the connecting conductors 25. The screening elements 38, 40 are arranged on a printed board 42 and electrically conductively connected with one another through conducting tracks provided on the printed board. The connecting conductors 25 are soldered on the printed board 42. A first contact element 44 formed as a plug sleeve projects from the printed board 42 and is connected with one of the connecting conductors 25 with interposition of the screening elements 38, 40. Furthermore, a second contact element 46 projects from the printed board 42 and is connected with the other connecting conductor with interposition of the screening elements 38, 40. The second contact element 46 is U-shaped as seen in a cross-section through the plug 24 in FIG. 5.

The screening elements 38, 40 as well as the contact elements 44 and 46 are arranged at the same side of the printed board 42 and form with the printed board 42 a premounted structural unit which is inserted in the cup-shaped housing part 36. The structural unit is inserted in the housing part 36 so that the printed board 42 faces with its free side toward the bottom of the housing part 36, and the screening elements 38, 40 as well as the contact elements 44, 46 are arranged at the open side of the housing part 36. The cable 25 extends substantially perpendicular to the printed board 42 outwardly of the housing part 36 and are received in guides 48 formed on the inner side of the lateral wall of the housing part 36.

The housing part 37 has a substantially flat inner side and an outwardly projecting circular-cylindrical portion 50 provided with a coaxial opening 52. A depression 54 is formed inside the portion 50 starting from its end sides, and a collar 56 is arranged in the depression to surround coaxially the opening 52. A third contact element is arranged in the portion 50 of the housing 37 so that a pair of contact strips 58 which face one another projects from the contact element on the inner side of the housing part 37. Three springy deformable arms 59 extending radially to the longitudinal axis 51 of the portion 50 project from the contact strips over a part of the inner periphery of the portion 50. The third contact element is inserted with its contact strips 58 from the outer side of the housing 37 until it passes through the inner side. The housing part 37 has also circumferential strips 60 which are formed of one piece with the portion 50 and are provided with U-shaped recesses 61 facing away from the portion 50. The housing part 37 is open between the strips 60 and the portion 50.

The assembly of the plug 24 is explained hereinbelow. First, the above described structural unit which is composed of the printed board 42, the screening element 38, 40 and the contact elements 44, 46 is produced. The structural unit is inserted in the housing part 36. With at least one screening element 38, 40 a drop 62 of a mass of a durable (long-lasting) elastic plastic, for example silicon, is applied on at least one screening element in the opening of the housing part 36 at the upwardly facing side of at least one part from its periphery. Subsequently, the housing part 37 is mounted. In particular, the housing part 37 with its substantially flat inner side facing toward the printed board 42 is placed on the housing part 36, so that its opening is closed. Table 24 extends through the U-shaped recesses 61 of the housing part 37. The plug sleeve 44 of the printed board 42 extends through the opening 52 of the cylindrical portion 50 of the housing part 37 and is arranged inside the collar 56. One leg of the second contact element 46 of the printed board 42 extends between two facing contact strips 58 with a springy spreading-apart, so that the arms 59 are connected electrically conductively with the second contact element 46. In its end position, the housing part 37 abuts against the edge of the opening of the housing part 36. The silicon drop 62 is brought in contact with the inner side of the housing part 37 and is flatly pressed. Finally, the inner chamber of the plug 24 is pressed with a casting mass of an electrically insulating material, for example synthetic plastic. The casting mass is then rigidified, and the housing parts 36, 37, and the casting mass form a solid composite. The silicon mass prevents that the screening elements 38 or 40 on which it is arranged is surrounded over its whole periphery by the casting mass or the housing parts 36, 37. During heating of the screening elements 38 and 40, they can expand with elastic compression of the silicon mass 62. Moreover, the screening elements 38 and 40 which are partially surrounded by the silicon mass 62 are not connected with the plug 24 rigidly but instead are uncoupled from the plug by the silicon mass 62.

The end region of the cylindrical portion 50 of the housing 37 has means for mounting the plug 24 on the socket 26 of the gas discharge lamp 22. This means include two diametrically opposite slots 64 extending from the end of the gas discharge lamp. They first extend inclinedly to the longitudinal axis 51 of the portion 50 and in their end region substantially perpendicular to the longitudinal axis 51. During the mounting of the plug 24 of the gas discharge lamp 22, each pin 35 of the socket 36 of the lamp 22 extends in a slot 64 and locked by turning of the plug 24 on the socket 26. In particular, the pins 35 reach the end region of the slots 64 extending perpendicular to the longitudinal axis 51. The slots 64 can be also provided in their end region each with an arresting sink 65 in which the corresponding pin 35 engages. During mounting of the plug 24, the plug connection 32 is inserted in the first contact element 44 of the plug in form of the plug sleeve with springy expansion of the same. Moreover, the arms 59 are brought in abutment against the conducting ring 34 with a pretensioning so that both connecting conductors 25 are connected each with a corresponding electrode of the gas discharge lamp 22. The collar 56 can be surrounded by an elastic sealing element 57 which extends in the depression 30 of the lamp socket 26.

Figure 6:
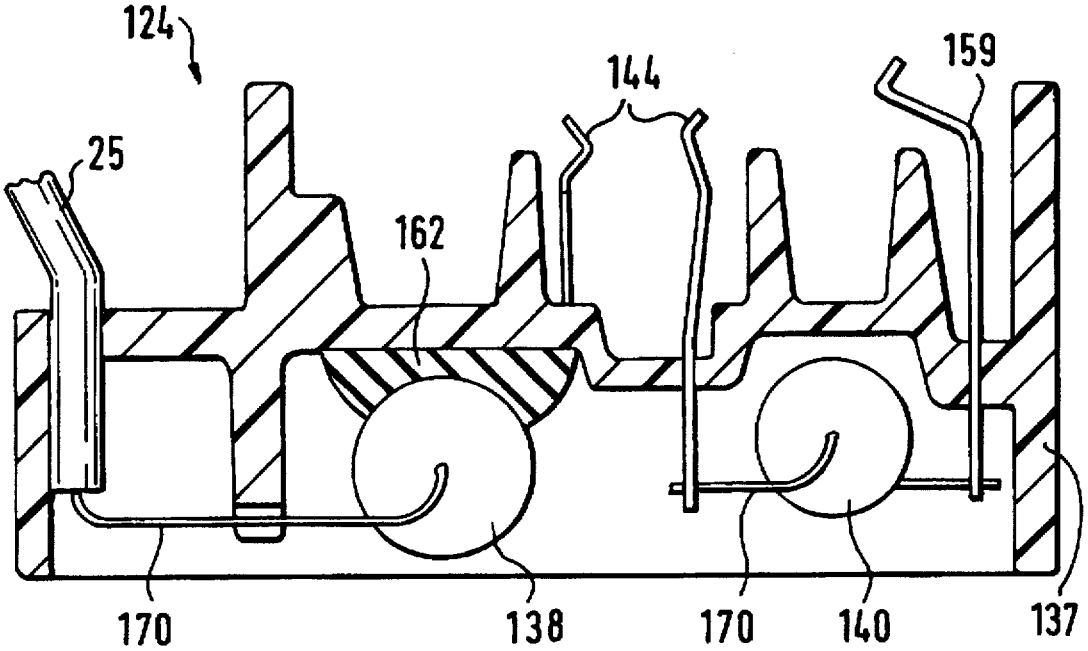
FIG. 6 is a view showing the plug in accordance with a second embodiment of the present invention in a longitudinal section.

In accordance with a second embodiment of the plug 124 shown in FIG. 6 which is different from the above described first embodiment, the printed board 42 can be dispensed with. The screening elements 138, 140 are arranged directly in a housing part 138 and held through their electrical connections during the assembly of the plug 124. The housing of the plug 124 is formed as a one-part element and composed only of one housing part 137. In the shown second embodiment, the contact element 144 in form of the plug sleeve and the contact element with the outwardly extending arms 159 are held in the housing part 137. The plug sleeve 144 and the arms 159 extend outwardly on the inner side of the housing part 137 and are soldered there on the electrical conductors 170 for connection with the screening elements 138, 140. The cables 22 extend with its ends through the housing part 137 on its inner side and are soldered there through electrical conductors with the screening elements 138, 140. A durable elastic mass 162, for example silicon, is applied between at least one part of the periphery of the at least one screening element 138, 140 and the adjoining housing part 137. The housing part 137 is subsequently filled with a casting mass of an electrical insulating material, for example synthetic plastic. The housing part 137 is formed otherwise as the housing part 37 of the first embodiment.

The cables 25 as shown in FIG. 1 extend to the reflector 12 after they exit the housing 36, 37 or 137 of the plug 24 or 124. A deviating device 80 can be arranged on the plug 24 or 124 so as to deviate the cables 25 so that the cables after exiting the housing 36, 37 or 137 extend away from the reflector 20. The deviating device 80 can be connected with the housing 36 or 37 or 137 of the plug 24 or 124 or can be formed of one piece with the same.

It will be understood that each of the elements described above, or two or more together, may also find a useful application in other types of constructions differing from the types described above.

While the invention has been illustrated and described as embodied in a plug for contacting gas discharge lamp, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A plug for contacting a gas discharge lamp, comprising at least one electrical screening element adapted to prevent a propagation of electromagnetic perturbing radiation produced by the gas discharge lamp during its operation through connecting conductors connected with the plug; a housing which is composed of an electrically conductive material and in which said at least one screening element is arranged; at least one casting mass composed of an electrically insulating material and at least partially filling said housing, said housing and said casting mass forming two elements; and a further mass composed of a durable elastic material and arranged between at least a part of a periphery of said at least one screening element and at least one of said two elements so that when during operation of the gas discharge lamp said at least one screening element is heated, it can expand with compression of said further mass composed of a durable elastic material.

2. The plug as defined in claim 1, wherein said mass of durable elastic material is silicon.

3. The plug as defined in claim 1; and further comprising a printed board; and at least second such screening element, said screening element being arranged on said printed board.

4. The plug as defined in claim 3, wherein said printed board and said screening elements together form a premountable structural unit which is insertable in said housing.

5. The plug as defined in claim 4, wherein said housing has at least one electrical contact element adapted for contacting the gas discharge lamp, said printed board having at least one contact element arranged so that during insertion of the printed board in said housing said contact element of said housing is brought in connection with said contact element of said printed board.

6. The plug as defined in claim 5, wherein said housing has an opening, said printed board having a further contact element which extends through said opening outwardly of said housing and adapted to directly contact the gas discharge lamp.

7. The plug as defined in claim 6, wherein said housing is composed of two housing parts, one of said housing parts holding said contact element on said housing and accommodating said printed board so that said contact element of said printed board is brought in connection with said contact element of said housing, another of said housing parts being connectable with said one housing part for covering said printed board, said other housing part being provided with said opening for passage of said further contact element of said printed board.

8. The plug as defined in claim 5, wherein said housing is composed of two housing parts, one of said housing parts holding said contact element on said housing and accommodating said printed board so that said contact element of said printed board is brought in connection with said contact element of said housing, another of said housing parts being connectable with said one housing part for covering said printed board.

* * * * *